US005140711A

United States Patent [19]

Johnson

[11] Patent Number: 5,140,711

[45] Date of Patent: Aug. 25, 1992

[54] CUSPIDOR CONVERTER

[76] Inventor: William J. Johnson, 1445 Sedalia Dr., Flower Mound, Tex. 75028

[21] Appl. No.: 558,860

[22] Filed: Jul. 27, 1990

Related U.S. Application Data

[63] Continuation-in-part of Ser. No. 288,766, Dec. 22, 1988, Pat. No. 4,949,405.

[51] Int. Cl.[5] ..... A61J 19/00

[52] U.S. Cl. ..... 4/258; 4/283; 141/340; 141/375

[58] Field of Search ..... 4/260, 283, 284, 258, 4/259, 270, 274, 285; 141/299, 297, 338, 340, 343, 367, 369, 375, 376; 220/287, 85 F, 86.1; 128/206.17

[56] References Cited

U.S. PATENT DOCUMENTS

| | | | |
|---|---|---|---|
| 172,341 | 1/1976 | Pfeifer | 141/331 X |
| 317,039 | 5/1885 | Strait | 4/258 |
| 434,423 | 8/1890 | Burrows | 220/86.1 X |
| 445,086 | 1/1891 | Scheller | 4/258 |
| 550,361 | 11/1895 | Alley | 4/283 |
| 618,996 | 2/1899 | Riedel et al. | 141/297 X |
| 676,924 | 6/1901 | Steiger, Jr. | 4/283 |
| 956,407 | 4/1910 | Orszag | 4/283 |
| 964,472 | 7/1910 | Johnson | 4/283 X |
| 973,189 | 10/1910 | Gerencier | 4/283 |
| 988,709 | 4/1911 | Hofer | 4/283 |
| 1,065,511 | 6/1913 | Edwards | 4/279 |
| 1,148,084 | 7/1915 | Dorn | 141/343 X |
| 1,210,397 | 1/1917 | Bang | 4/283 |
| 1,245,013 | 10/1917 | Nowakowski | 4/283 |
| 1,305,428 | 6/1919 | Wilson | 4/258 |
| 1,330,828 | 2/1920 | Wilson | 4/258 |
| 1,352,165 | 9/1920 | Agrillo | 141/344 X |
| 1,938,138 | 12/1933 | Downs | 141/299 X |
| 2,063,559 | 12/1936 | Rogers | 4/258 |
| 2,112,307 | 3/1938 | Ryder | 220/287 X |
| 2,126,701 | 8/1938 | Hamiton | 4/258 |
| 2,218,002 | 10/1980 | Hamiton | 4/258 |
| 2,440,783 | 5/1948 | Peart | 4/283 X |
| 2,643,024 | 6/1953 | Cronheim | 220/287 X |
| 2,703,670 | 3/1955 | Voight | 220/287 |
| 2,810,491 | 10/1957 | Goldschmidt | 220/86.1 X |
| 3,606,074 | 9/1971 | Hayes | 220/287 |
| 4,162,547 | 7/1979 | Jenkins | 4/259 |
| 4,503,572 | 3/1985 | Dawson | 4/258 |
| 4,583,668 | 4/1986 | Maynard, Jr. | 220/287 X |
| 4,850,403 | 7/1989 | Wiese | 141/340 X |

*Primary Examiner*—Henry J. Recla
*Assistant Examiner*—Robert M. Fetsuga
*Attorney, Agent, or Firm*—W. Kirk McCord

[57] ABSTRACT

Apparatus for adapting open-mouthed containers, such as 12- and 16-ounce beverage bottles, for use as a cuspidor. The converter includes a housing having top and bottom openings and an inverted frusto-conical member tapering downwardly and inwardly from a top edge of the housing to a predetermined position therebelow. The conical member has a bottom aperture which communicates with the top opening. An adapter is disposed beneath the conical member for connecting the apparatus to a container. The adapter has a central aperture communicating with the bottom aperture of the conical member for conducting material introduced into the housing through the top opening thereof into the container. The conical member cooperates with an inner wall of the housing to substantially prevent material from escaping from the housing through the top opening. The adapter includes a plurality of cylindrical members having respective discrete outside diameters adapted to fit into the respective bottle mouths having respective discrete inside diameters, to provide a snug-fit engagement, so that the apparatus can be coupled to bottles having various sized mouths.

10 Claims, 4 Drawing Sheets

CUSPIDOR CONVERTER

This application is a continuation-in-part of copending patent application Ser. No. 07/288,766, filed on Dec. 22, 1988, now U.S. Pat. No. 4,949,405.

FIELD OF THE INVENTION

This invention relates generally to cuspidors and particularly to a device for converting a common container into a cuspidor.

BACKGROUND OF THE INVENTION

Cuspidors, also known as spittoons, are used for disposal of waste fluid, such as spitted tobacco waste from chewing tobacco. A tobacco chewer has a need to periodically expectorate the tobacco waste, but he is often unable to find a suitable receptacle for receiving such waste. It is inconvenient and impractical for a tobacco user to carry around with him a suitable receptacle for the disposition of tobacco waste.

DESCRIPTION OF THE PRIOR ART

According to prior practice, the earliest spittoons were large and bulky receptacles, such as the brass spittoon which is depicted in western movies to have been a fixture in every saloon in the West. In addition to being heavy, such receptacles were unsanitary and unpleasant to clean. Furthermore, if the receptacles were tipped over, the contents thereof would spill out of the receptacle.

The advent of lighter weight, inexpensive manufacturing materials, such as plastics and papers, fostered the development of disposable spittoons, which provided a more sanitary method of disposing of spittle. Although these disposable spittoons represented an improvement over the heavy brass spittoons, disposable spittoons were not always available to the tobacco chewer and the problem of spillage continued to occur.

Numerous patents have been issued on various types of prior art cuspidors. For example, U.S. Pat. Nos. 550,361; 676,924; 964,472; 1,065,511; and 2,440,783 teach various types of cuspidors, the object of which is to solve or attempt to solve the aforementioned spillage problem. Other types of cuspidors are illustrated in U.S. Pat. Nos. 879,314 (cuspidor having a reversible bowl and a valve connection whereby the opening in the cover is automatically closed after being opened by a user's foot); U.S. Pat. No. 2,126,701 (sputum cup comprised of a disposable cup and a flanged lid for engaging the top part of the cup); U.S. Pat. No. 2,218,002 (sputum cup having a disposable receptacle with a flanged lid); U.S. Pat. No. 4,162,547 (a pocket cuspidor comprised of a three-part receptacle with a disposable inner bag); and U.S. Pat. No. 4,503,572 (disposable receptacle with a flanged lid tapering toward a central opening in the receptacle). Still other types of cuspidors are shown in U.S. Pat. Nos. 199,541; 279,739; 317,039; 445,086; 956,407; and 1,245,013 and in British Patent No. 18,299.

One problem associated with prior art cuspidors, including disposable cuspidors, is that the special configuration of the cuspidor receptacle makes it expensive to replace. Furthermore, the tobacco user must still carry the disposable receptacle around with him until it has been used and disposed of because cuspidors are not readily available. Consequently, tobacco users often use common containers, such as beverage cans and the like, in which to expectorate. Such common containers are typically not adapted for receiving spittle, primarily because the openings therein are not of sufficient size and proper shape.

OBJECTS OF THE INVENTION

It is therefore the principal object of the present invention to provide a device for adapting a variety of containers for use as a cuspidor.

It is another object to provide a device for attachment to standard-sized beverage bottles in order to convert the bottles into cuspidors.

Another object of the invention is to provide a cuspidor in which material introduced therein is substantially inhibited from escaping when the cuspidor is not in a substantially vertical position.

Yet another object of the invention is to provide a relatively inexpensive cuspidor.

Still another object of the invention is to provide a cuspidor in which a first portion thereof is reusable and a second portion thereof containing the spittle is disposable.

A further object of the invention is to provide a cuspidor which is easily and conveniently handled and transported.

Still a further object of the invention is to provide a cuspidor having an aesthetically pleasing appearance.

SUMMARY OF THE INVENTION

These and other objects are accomplished in accordance with the present invention wherein apparatus is provided for selectively adapting a container having an open mouth for use as a cuspidor. The apparatus includes a housing having top and bottom openings and an interior passageway communicating therebetween; conduit means depending from a top part of the housing into the passageway and having a bottom aperture communicating with the top opening for directing material introduced into the housing through the top opening downwardly toward the bottom opening; and adapter means depending from a bottom part of the housing. The adapter means is at least partially insertable into the open mouth of the container to couple the apparatus to the container. The adapter means includes a central aperture communicating with the bottom aperture of the conduit means to direct the material into the container.

In accordance with one feature of the invention, the adapter means is comprised of a first conical portion tapered inwardly and downwardly from an inner wall of the housing for directing material into the central aperture. The adapter means is further comprised of a second conical portion tapering inwardly and downwardly from the first conical portion. A top part of the second conical portion has an outside diameter which is greater than an inside diameter of the mouth of a first container. A bottom part of the second conical portion has an outside diameter which is less than the inside diameter of the mouth of a second container, such that the second conical portion is adapted for insertion into container mouths having a predetermined range of inside diameters to provide a cork-like fit.

In accordance with another feature of the invention, an inner wall of the housing includes a plurality of nubs projecting inwardly therefrom, adjacent the bottom part of the housing. The nubs are coupled to a top part of the first conical portion to locate the adapter means with respect to the bottom part of the housing.

In accordance with yet another feature of the invention, the conduit means include a flange member extending downwardly from an upper edge of the conduit means. The flange member extends over a top edge of the housing and is attached to an outer wall of the housing, to locate the conduit means with respect to the top part of the housing.

In accordance with a further feature of the invention, the first conical portion of the adapter means includes a flange member extending downwardly from a top edge of the first conical portion around substantially the entire perimeter of the top edge. The bottom part of the housing is enlarged with respect to the remainder of the housing. The flange member is in parallel relationship with an inner wall of the enlarged bottom part of the housing. The nubs projecting from the inner wall of the housing are coupled to a top surface of the first conical portion of the adapter means and the flange member is coupled to an inner wall of the enlarged bottom part of the housing to locate the adapter means with respect to the bottom part of the housing.

The apparatus according to the present invention is adapted for attachment to standard beverage bottles having different size mouths. Material introduced into the apparatus is directed into a selected container, substantially without spillage. A disposable cuspidor is therefore provided using readily available and disposable containers.

BRIEF DESCRIPTION OF THE DRAWINGS

Other objects and advantages of the invention will be apparent from the Detailed Description and Claims when read in conjunction with the accompanying drawings wherein:

DETAILED DESCRIPTION OF THE PREFERRED EMBODIMENT

In the description which follows like parts are marked throughout the Specification and Drawings, respectively. The drawings are not necessarily to scale and in some instances proportions have been exaggerated in order to more clearly depict certain features of the invention.

Figure 1:
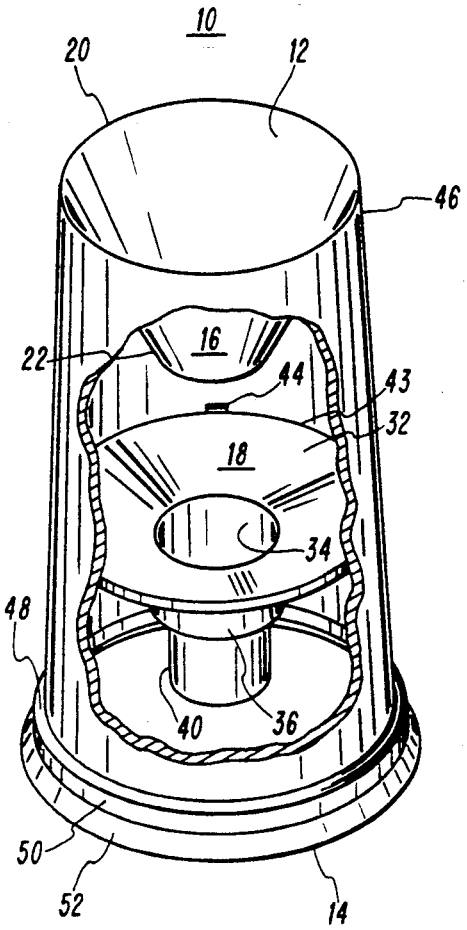
FIG. 1 is a perspective view of a first embodiment of a cuspidor converter in accordance with the present invention, in which a portion of the outer wall is broken away.
Figure 2:
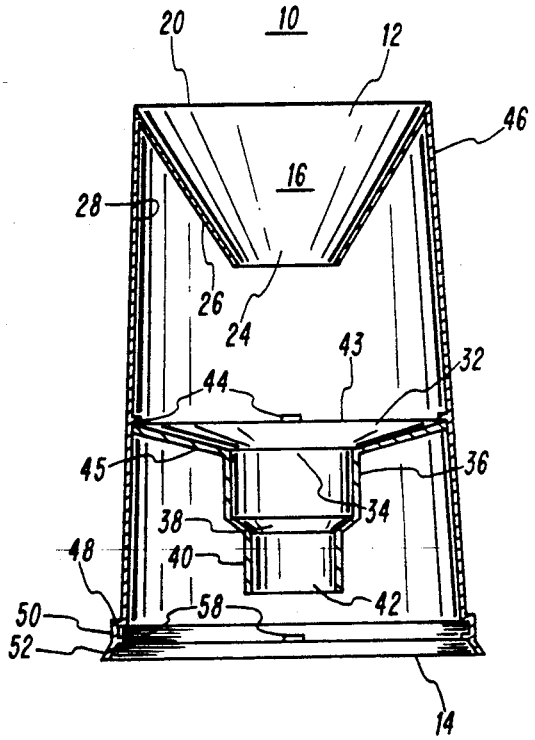
FIG. 2 is a sectional view of the cuspidor converter of FIG. 1, taken vertically through the center thereof.
Figure 3:
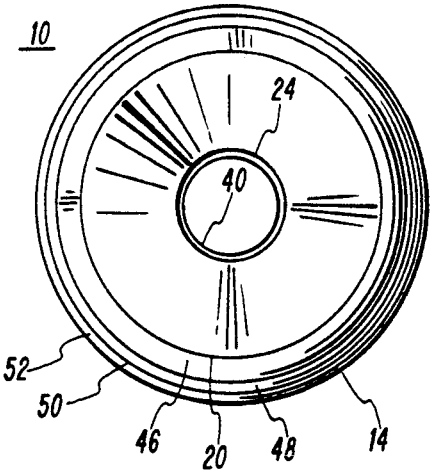
FIG. 3 is a top plan view of the cuspidor converter of FIG. 1.

Referring to FIGS. 1, 2 and 3, a cuspidor converter 10 has respective top and bottom openings 12 and 14 with a passageway communicating therebetween and first and second interior baffles 16 and 18, respectively. First baffle 16 is in the shape of an inverted, truncated cone, the upper edge of which defines an upper edge 20 of converter 10. First baffle 16 narrows from a diameter of approximately 1 13/16 inches at upper edge 20 to a diameter of approximately 9/16 inch at lower edge 22 to define a first intermediate aperture 24 at lower edge 22. The diameter of aperture 24 is maintained sufficiently small so that any matter passing therethrough can also pass through the top opening of a host container to which converter 10 is joined. First baffle 16 is tapered downwardly and inwardly to a depth of approximately one inch below upper edge 20, such that all matter entering converter 10 through top opening 12 is directed downwardly and toward the center of converter 10 through aperture 24. As best seen in FIG. 2, outer wall 26 of first baffle 16 cooperates with inner wall 28 of converter 10 to trap spittle and other waste matter therebetween, thereby preventing or substantially reducing spillage from converter 10 through top opening 12 when converter 10 is tipped over.

Second baffle 18 is disposed beneath first baffle 16 and is comprised of an inverted first conical portion 32 having a second intermediate aperture 34 substantially in registration with first intermediate aperture 24, a first substantially cylindrical portion 36 below first conical portion 32, followed by an inverted second conical portion 38 and a second substantially cylindrical portion 40. Cylindrical portion 40 has a third intermediate aperture 42 at a bottom edge thereof. A central passageway communicates between second and third intermediate apertures 34 and 42.

Upper surface 43 of first conical portion 32 is located at approximately the mid-point of the height of converter 10 and is joined to inner wall 28 by means of a continuous weld or by glue to provide a relatively tight seal separating the upper and lower portions of converter 10. A plurality of nubs 44 are spaced at predetermined intervals around inner wall 28 for locating second baffle 18. Respective undersurfaces of nubs 44 are in abutting relationship with upper surface 43 of first conical portion 32. Upper surface 43 is relatively flat and lies substantially in a plane which is substantially parallel to the plane in which upper edge 20 and top opening 12 lie. Wall 45 of first conical portion 32 tapers sharply inward and slightly downward from inner wall 28, terminating at first cylindrical portion 36.

First cylindrical portion 36 extends downwardly from first conical portion 32 approximately $\frac{3}{4}$ inch. Second conical portion 38 extends downwardly approximately $\frac{1}{4}$ inch below first cylindrical portion 36 and second cylindrical portion 40 extends approximately $\frac{3}{4}$ inch below second conical portion 38. The outside diameter of first cylindrical portion 36 is sized to allow first cylindrical portion 36 to be inserted into the mouth of a large-mouthed standard sized 12 or 16 ounce beverage bottle 47 to provide a tight, cork-like fit, as best seen in FIG. 4A. Similarly, the outside diameter of second cylindrical portion 40 is sized to allow second cylindrical portion 40 to be inserted into the mouth of a regular-mouthed standard 12 or 16 ounce beverage bottle 49 to provide a tight, cork-like fit, as best seen in FIG. 4B.

Projecting outwardly from outer wall 46 of converter 10 is a relatively flat shelf 48. A substantially vertical wall 50 extends perpendicularly downward from an outer edge of shelf 48. A bottom portion of converter 10 is defined by an outwardly tapering wall 52.

In the preferred embodiment the height of converter 10 from upper edge 20 to shelf 48 is on the order of three inches. The inside diameter of converter 10 at vertical wall 50 is slightly smaller than the smallest outside diameter of the top rim of a standard 12 ounce or 16 ounce beverage can (i.e., on the order of 2.328 inches). The material from which converter 10 is manufactured is sufficiently flexible to account for differences in the diameter of the top rim of various beverage cans and yet is rigid enough to provide a snug fit engagement therebetween to maintain a proper liquid seal.

Figure 4C:
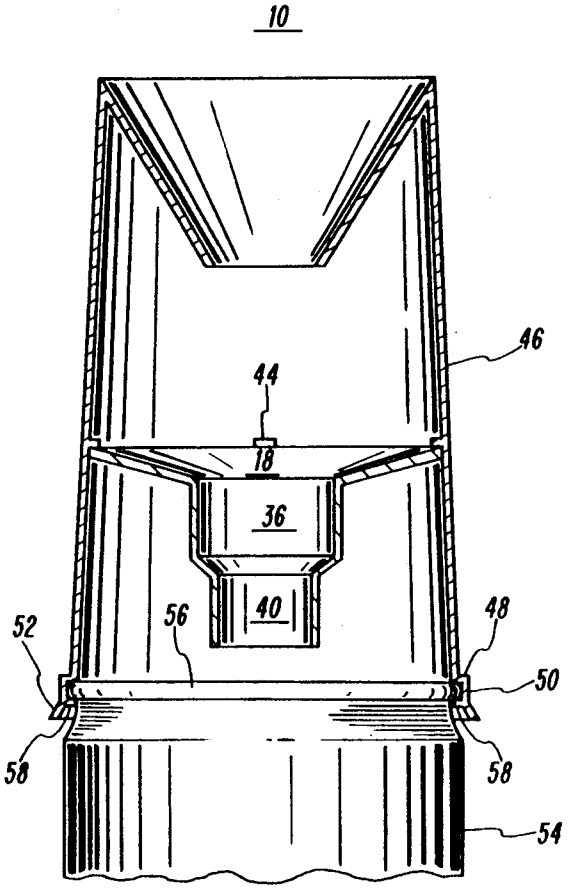
FIGS. 4A–4C are respective sectional views of the cuspidor converter of FIG. 1, illustrating the engagement between the converter and various containers to provide a cuspidor.
Figure 4B:
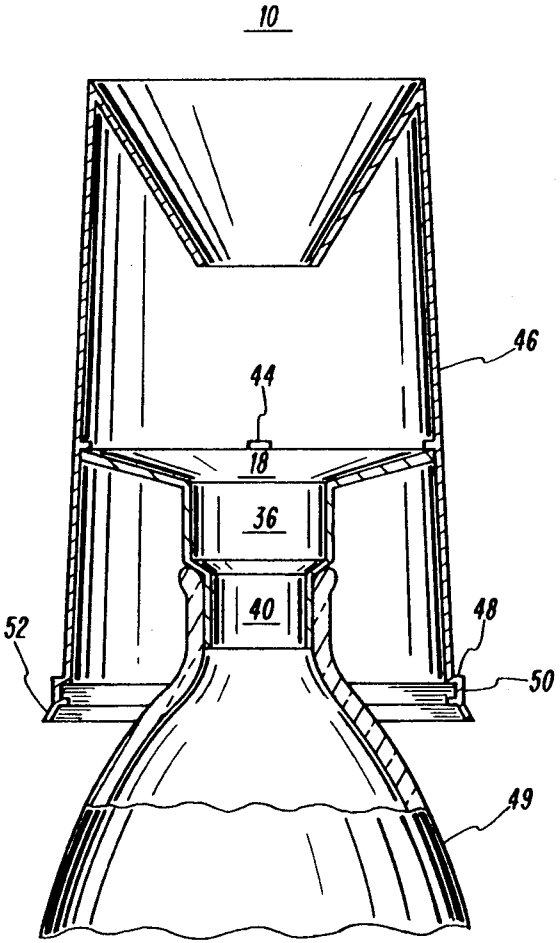
Figure 4A:
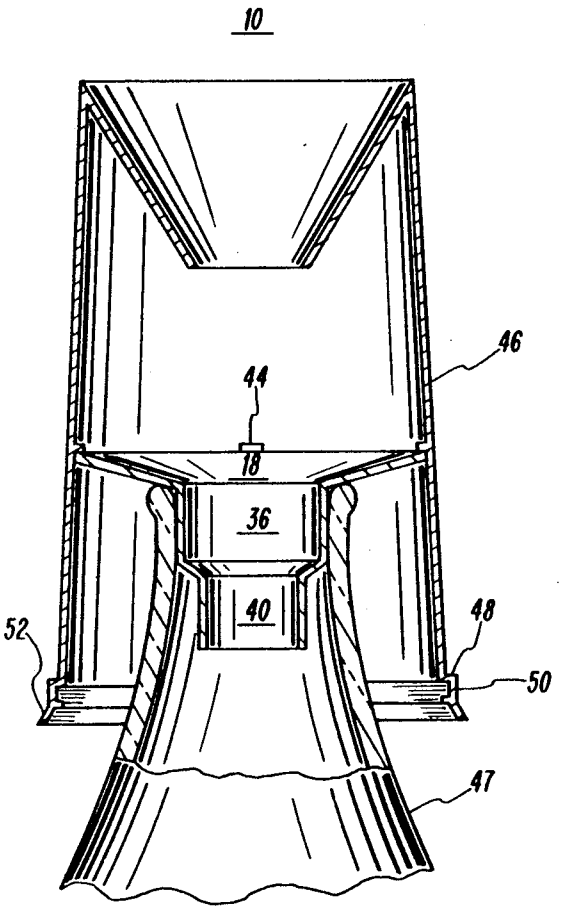

As best seen in FIG. 4C, a standard 12 ounce or 16 ounce beverage can 54 is insertable into converter 10 through bottom opening 14, such that top rim 56 of beverage can 54 engages an inner surface of shelf 48, which functions as a shoulder to prevent further upward movement of can 54. Can 54 is urged into converter 10 by the inwardly tapering inner surface of wall 52.

A plurality of nubs 58 are spaced at predetermined intervals and protrude inwardly from an inner surface of converter 10 at approximately the intersection between vertical wall 50 and tapering wall 52. Nubs 58 engage the undersurface of rim 56 to limit the downward movement of beverage can 54 and retain can 54 in position within converter 10. Each nub 58 extends inwardly approximately 0.025 inch and has a thickness in the horizontal dimension of no more than ¼ inch and a height in the vertical dimension of not more than 1/32 inch. A vertical spacing of at least 3/32 inch should be available between the top surface of each nub 58 and the interior surface of shelf 48 in order to provide adequate room for rim 56 to be seated. During insertion of can 54 into converter 10, the bottom portion of converter 10 flexes outwardly so that rim 56 can clear nubs 58. After insertion, the bottom portion closes back in, such that nubs 58 engage the undersurface of rim 56.

Figure 5:
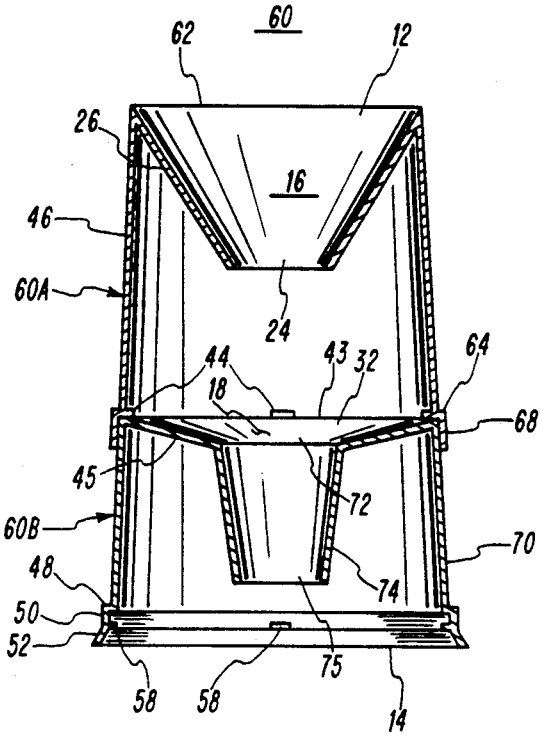
FIG. 5 is a sectional view of a second embodiment of a cuspidor converter according to the present invention, taken vertically through the center.
Figure 6:
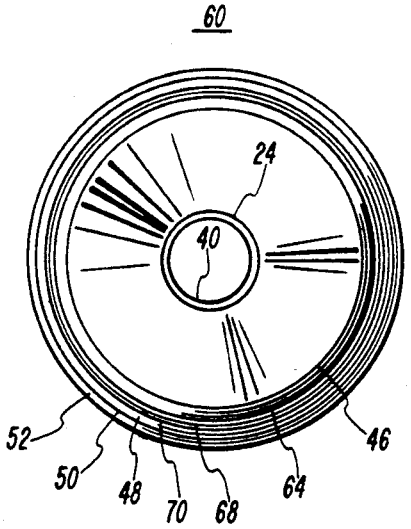
FIG. 6 is a top plan view of the cuspidor converter of FIG. 5.

Referring to FIGS. 5 and 6, an alternate embodiment of a cuspidor converter 60 is depicted. Converter 60 is comprised of an upper portion 60A and a lower portion 60B. Upper portion 60A tapers outwardly and downwardly from top edge 62 and includes a laterally extending shelf 64, which is sufficiently wide to provide an undersurface for affixing upper portion 60A to top surface 43 of interior baffle 18.

Lower wall 68 of upper portion 60A extends downwardly approximately ¼ inch below shelf 64 and slightly outwardly therefrom. The interior surface of lower wall 68 is affixed to an outer surface of wall 70 of lower portion 60B by gluing or the like to complete the joinder of upper and lower portions 60A and 60B.

Interior baffle 18 is comprised of an inverted first conical portion 72 having a central aperture therein and an inverted second conical portion 74, which is tapered gradually inwardly and downwardly from first conical portion 72 to define a funnel-shaped member. The bottom part of second conical portion 74 includes a central aperture 75, which communicates with the central aperture in first conical portion 72. The maximum diameter of second conical portion 74 is slightly greater than the inside diameter of the opening of large-mouthed standard 12 and 16 ounce beverage bottles and the minimum diameter of second conical portion 74 is slightly less than the inside diameter of regular-mouthed standard 12 and 16 ounce beverage bottles. Thus, second conical portion 74 is dimensioned to fit into various sized mouths of standard 12 and 16 ounce beverage bottles to provide a tight, cork-like fit. Except as specifically mentioned above, converter 60 is substantially the same as converter 10, previously described with reference to FIGS. 1-3.

Figure 7:
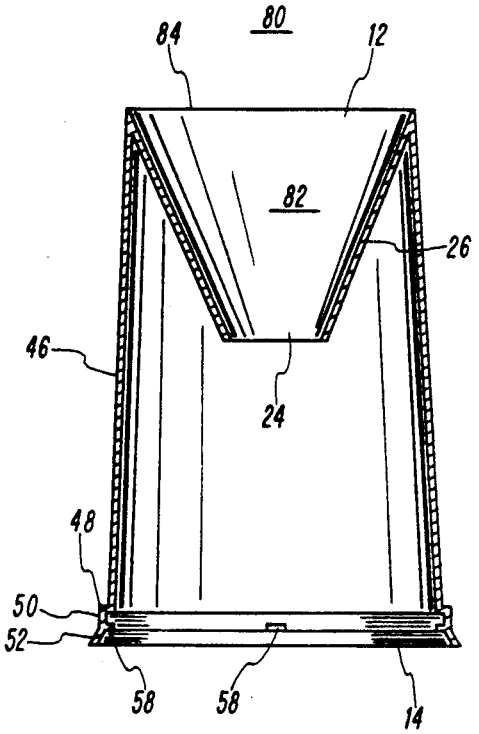
FIG. 7 is a sectional view of a third embodiment of the cuspidor converter according to the present invention, taken vertically through the center thereof.
Figure 8:
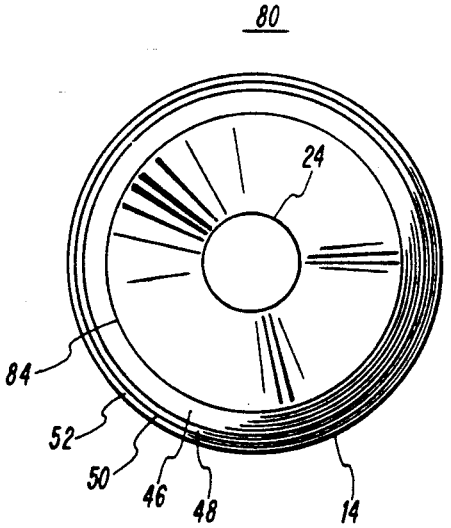
FIG. 8 is a top plan view of the cuspidor converter of FIG. 7.

Referring to FIGS. 7 and 8, yet another embodiment of a cuspidor converter 80 according to the present invention is depicted. Converter 80 is different from converters 10 and 60 previously described in that converter 80 is integrally formed as a single manufactured piece. No welding or gluing is required in order to construct converter 80. Converter 80 supports standard sized 12 and 16 ounce beverage cans. Only one baffle 82, which has an inverted frusto-conical shape, is depicted. Baffle 82 tapers inwardly and downwardly from top edge 84 of converter 80 in substantially the same manner as baffle 16, described above with reference to FIGS. 1-3. Because no other interior baffle is present, baffle 82 can be extended a greater distance downwardly into converter 80 than baffle 16 previously described. Otherwise, converter 80 is coupled to standard sized beverage cans in substantially the same manner as described above with reference to FIGS. 1-3.

Figure 9:
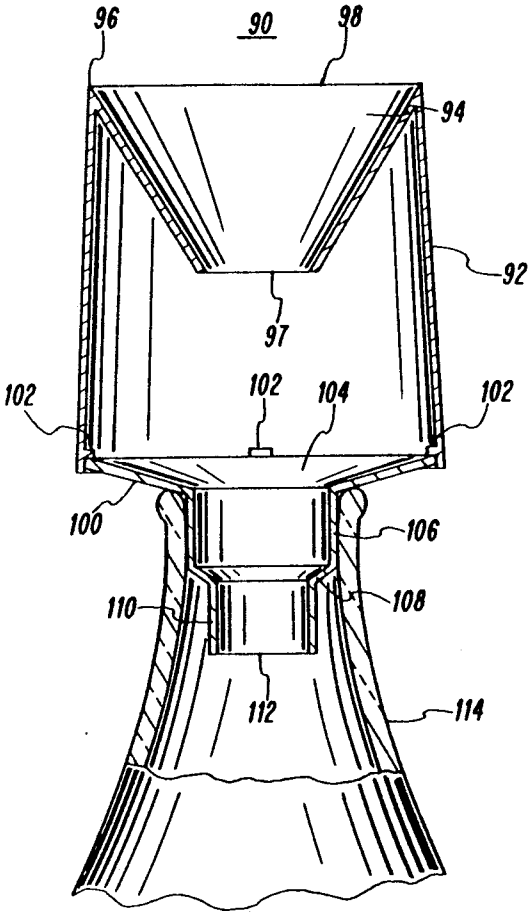

Referring to FIG. 9, a cuspidor converter 90 according to the present invention includes a housing 92 having an inverted conical member 94 integrally formed at a top part thereof, such that conical member 94 tapers inwardly and downwardly within housing 92 from a top edge 96 thereof to define a funnel-shaped member. Conical member 94 has a bottom aperture 97 communicating with a top opening 98 of housing 92.

Figure 10:
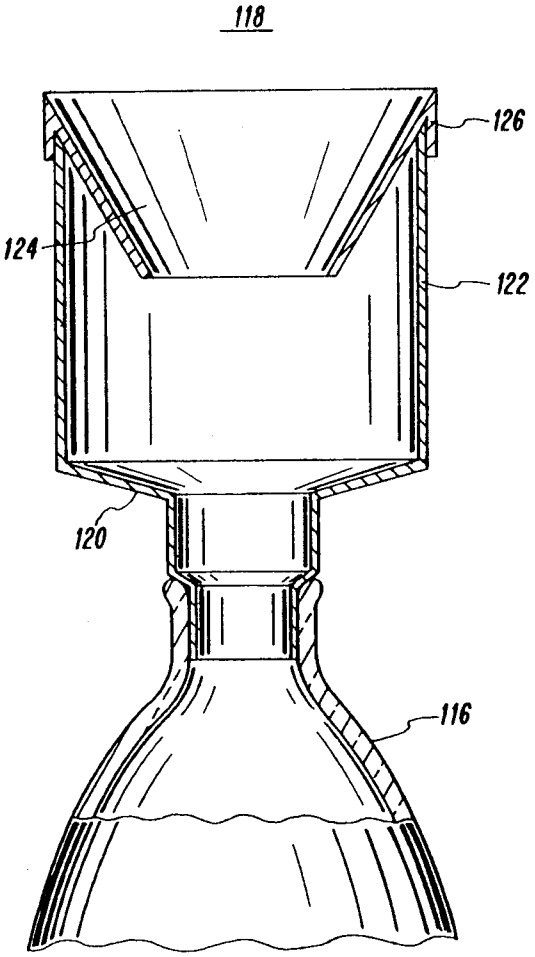

An adapter 100 depends from a bottom part of housing 92 and is connected to a shoulder portion defined by a plurality of nubs 102 by any suitable means, such as by gluing or welding. Adapter 100 includes a first inverted conical portion 104 tapering inwardly and downwardly from an inner wall of housing 92; a first substantially cylindrical portion 106 depending from first conical portion 104; a second inverted conical portion 108 tapering inwardly and downwardly from first substantially cylindrical portion 106; and a second substantially cylindrical portion 110 depending from second conical portion 108. Portions 104, 106, 108 and 110 are integrally formed to constitute adapter 100. Adapter 100 has a central aperture 112, which communicates with bottom aperture 97 for directing the material introduced into housing 92 through top opening 98 into a container 114. The outside diameter of first cylindrical portion 106 is sized to allow first cylindrical portion 106 to be inserted into the mouth of a large-mouthed standard 12- or 16-ounce beverage bottle 114 to provide a tight, cork-like fit, as shown in FIG. 9. Similarly, the outside diameter of second cylindrical portion 110 is sized to allow second cylindrical portion 110 to be inserted into the mouth of a regular-mouthed standard 12- or 16-ounce beverage bottle 116 (See FIG. 10) to provide a tight, cork-like fit. The cuspidor converter 118, as depicted in FIG. 10 is substantially the same as cuspidor converter 90, except that adapter 120 is integrally formed at a bottom part of housing 122, and inverted conical member 124 includes a flange 126, which fits over a top edge of housing 122 and is attached to an outer wall of housing 122 by any suitable means, such as by welding or gluing.

Figure 11:
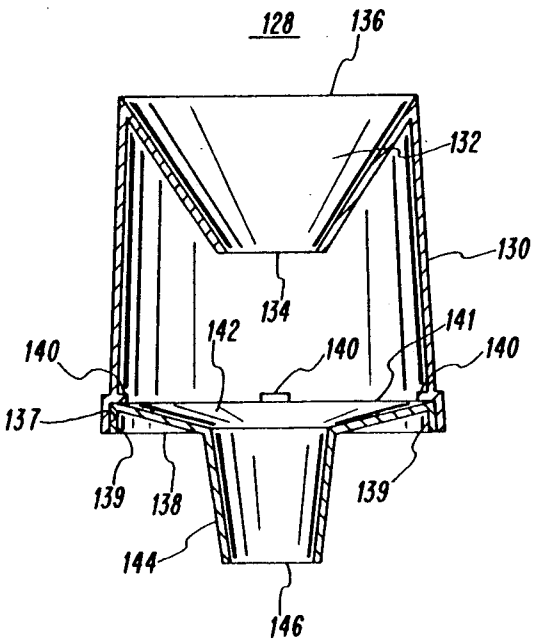
FIGS. 9, 10 and 11 are respective sectional views of respective fourth, fifth and sixth embodiments of the cuspidor converter according to the present invention, taken vertically through the respective centers thereof.

Referring to FIG. 11, a cuspidor converter 128 according to the present invention is comprised of a housing 130 having inverted conical member 132 integrally formed at a top part thereof, such that conical member 132 tapers inwardly and downwardly from a top edge of housing 130. Conical member 132 has a bottom aperture 134 which communicates with a top opening 136 of housing 130. An adapter 138 depends from a bottom part of housing 130 and includes a flange 139, which is in parallel relation with an inner vertical wall 137 on a bottom part of housing 130 and is coupled to vertical wall 137 by any suitable means, such as gluing or welding. A plurality of nubs 140 project inwardly from an inner wall of housing 130 and are coupled to a top surface 141 of a first conical portion 142. The attachment between nubs 140 and top surface 141 and the attachment between flange 139 and vertical wall 137 locates adapter 138 with respect to the bottom part of housing 130. Adapter 138 includes a first inverted conical portion 142, which tapers inwardly and downwardly from an inner wall of housing 130 and a second inverted conical portion 144 tapering inwardly and downwardly from first conical portion 142. A central aperture 146 extends through first and second conical portions 142 and 144. The maximum outside diameter of second conical portion 144 is slightly greater than the inside diameter of the opening of large-mouthed standard 12- and 16-ounce beverage bottles and the minimum outside diameter of second conical portion 144 is slightly less than the inside diameter of regular-mouthed standard 12- and 16-ounce beverage bottles. Thus, second conical portion 144 is dimensioned to fit into various sized mouths of beverage bottles to provide a tight, cork-like fit. The depth of insertion of second conical portion 144 into a selected beverage bottle will of course depend upon the diameter of the bottle mouth.

The cuspidor converters 90, 118 and 128, described above with reference to FIGS. 9–11, are suitable for being connected to standard beverage bottles. One skilled in the art will appreciate that the cuspidor converters 90 and 118, depicted in FIGS. 9 and 10, are substantially similar to the cuspidor converter 10, described above as referenced to FIGS. 1–4, except that converters 90 and 118 are not designed for attachment to beverage cans. Similarly, the cuspidor converter 128, depicted in FIG. 11, is substantially similar to the converter 60, but is not attachable to standard beverage cans. In essence, the lower portion of converter 60, containing the beverage can engagement members 48 and 58, has been eliminated from converter 128.

The cuspidor converter according to the present invention has the advantage of adapting readily available containers, such as standard sized beverage cans and bottles, to serve as a convenient and sanitary receptacle for the disposal of spittle and other waste material. The converter can be quickly and conveniently attached to and detached from standard containers, which would otherwise probably be disposed of. The converter device can be reused in connection with other disposable containers. The interior baffle arrangement guards against spillage, which makes the converter safe, sanitary and convenient to use. The converter is preferably made of a reground biodegradable rubberized polystyrene plastic using a thermoforming process, which yields a wall thickness of approximately 0.020 inch. The thickness of the material should be such as to provide for the desired flexibility of the material without detracting from the needed structural integrity thereof.

Various embodiments of the invention have now been described in detail. Since it is obvious that changes in and additions to the above-described preferred embodiment may be made without the departing from the nature, spirit and scope of the invention, the invention is not to be limited to said details, except as set forth in the appended claims.

What is claimed is:

1. Apparatus for selectively adapting a container having an open mouth for use as a cuspidor, comprising, in combination:

a housing having top and bottom openings and an interior passageway communicating therebetween;

conduit means depending from a top part of said housing into said passageway and having a bottom aperture communicating with said top opening for directing material introduced into said housing through said top opening downwardly toward said bottom opening; and adapter means depending from a bottom part of said housing, said adapter means being at least partially insertable into the open mouth of the container to couple said apparatus to the container, said adapter means having a central aperture communicating with said bottom aperture of said conduit means to direct the material into the container, said adapter means being comprised of a first conical portion tapering inwardly and downwardly from an inner wall of said housing for directing the material into said central aperture, said adapter means being further comprised of a second conical portion tapering inwardly and downwardly from said first conical portion, a top part of said second conical portion having an outside diameter which is greater than an inside diameter of the mouth of a first container, a bottom part of said second conical portion having an outside diameter which is less than an inside diameter of the mouth of a second container, the inside diameter of the mouth of the second container being less than the inside diameter of the mouth of the first container, such that said second conical portion is adapted for insertion into container mouths having a predetermined range of inside diameters to provide a cork-like fit.

2. The apparatus of claim 1 wherein the container is a bottle having a substantially cylindrical neck portion for receiving at least a portion of said adapter means, an outer surface of said adapter means being engageable with an inner surface of said neck portion in frictional engagement to provide said cork-like fit.

3. The apparatus of claim 1 wherein said conduit means is comprised of an inverted conical member tapering inwardly and downwardly from said top part of said housing to a predetermined position below a top edge of said housing.

4. The apparatus of claim 1 wherein an outer wall of said conduit means cooperates with an inner wall of said housing for trapping material therebetween when said apparatus is not in a substantially vertical position, thereby substantially preventing material from escaping from said housing through said top opening.

5. Apparatus for selectively adapting a container having an open mouth for use as a cuspidor, comprising, in combination:

a housing having top and bottom openings:

conduit means tapering inwardly and downwardly from a top part of said housing and having a bottom aperture communicating with said top opening for directing material introduced into said housing through said top opening downwardly toward said bottom opening: and adapter means located beneath said conduit means for connecting said apparatus to said container, said adapter means having a central aperture communicating with said bottom aperture, said adapter means including a first conical portion tapering inwardly and downwardly from an inner wall of said housing and a second conical portion tapering inwardly and downwardly from said first conical portion, a top part of said second conical portion having an outside diameter which is greater than an inside diameter of the mouth of a first container and a bottom part of said second conical portion having an outside diameter which is less than an inside diameter of the mouth of a second container, the inside diameter of the mouth of the second container being less than the inside diameter of the mouth of the first container, whereby said second conical portion is adapted for insertion into container mouths having a predetermined range of sizes to provide a cork-like fit, said adapter means depending from a bottom part of said housing.

6. The apparatus of claim 5 wherein said first conical portion substantially closes off said bottom opening of said housing for directing material introduced into said housing into said central aperture, said central aperture communicating with the inside of the container when said second conical portion is inserted into the container, whereby the material is directed into the container.

7. The apparatus of claim 5 wherein an outer wall of said first conical portion cooperates with an inner wall of said housing for trapping material therebetween when said apparatus is not in a substantially vertical position, thereby substantially preventing the material from escaping from said housing through said top opening.

8. The apparatus of claim 5 further including a plurality of nubs projecting inwardly from an inner wall of said housing adjacent said bottom part of said housing, said nubs being coupled to a top part of said first conical portion to locate said adapter means with respect to said bottom part of said housing.

9. The apparatus of claim 5 wherein said conduit means includes a flange member extending downwardly from an upper edge of said conduit means, said flange member extending over a top edge of said housing and being attached to an outer wall of said housing to locate said conduit means with respect to said top part of said housing.

10. The apparatus of claim 5 wherein said first conical portion includes a flange member extending downwardly from a top edge thereof around substantially the entire perimeter of said top edge, said bottom part of said housing being enlarged with respect to the remainder of said housing, said housing further including a plurality of nubs projecting inwardly from an inner wall of said housing adjacent said bottom part of said housing, said flange member being in parallel relation with an inner wall of said enlarged bottom part of said housing, said nubs being coupled to a top surface of said first conical portion and said flange member being coupled to said inner wall of said enlarged bottom part to locate said adapter means with respect to said bottom part of said housing.

* * * * *